US007845433B2

(12) United States Patent
Calderoni et al.

(10) Patent No.: US 7,845,433 B2
(45) Date of Patent: Dec. 7, 2010

(54) DEVICE AND PROCEDURE FOR THE INSERTION OF A NEW DRILLING STRING-ELEMENT INTO THE DRILL-STRING OF A WELL

(75) Inventors: Angelo Calderoni, San Donato Milanese (IT); Giorgio Girola, Cislago (IT)

(73) Assignee: ENI S.p.A., Rome (IT)

( * ) Notice: Subject to any disclaimer, the term of this patent is extended or adjusted under 35 U.S.C. 154(b) by 0 days.

(21) Appl. No.: 11/449,662

(22) Filed: Jun. 9, 2006

(65) Prior Publication Data

US 2006/0278434 A1 Dec. 14, 2006

(51) Int. Cl.
*E21B 34/06* (2006.01)

(52) U.S. Cl. ..... 175/317; 175/318

(58) Field of Classification Search ..... 175/317, 175/318

See application file for complete search history.

(56) References Cited

U.S. PATENT DOCUMENTS

| | | | | |
|---|---|---|---|---|
| 1,491,986 | A | 4/1924 | Greene | |
| 2,102,555 | A | 12/1937 | Dyer | |
| 2,158,356 | A | 5/1939 | Dyer | |
| 3,298,385 | A | 1/1967 | Jackson et al. | |
| 4,310,050 | A * | 1/1982 | Bourgoyne, Jr. | 166/318 |
| 4,448,267 | A | 5/1984 | Crawford, III et al. | |
| 6,253,861 | B1 * | 7/2001 | Carmichael et al. | 175/237 |
| 2004/0154835 | A1 | 8/2004 | Allen et al. | |

* cited by examiner

*Primary Examiner*—William P Neuder
(74) *Attorney, Agent, or Firm*—Oblon, Spivak, McClelland, Maier & Neustadt, L.L.P.

(57) ABSTRACT

A device and the relative are described, for the insertion of a new drilling string-element into a drilling-string essentially including a short pipe-shaped body (C) having, at opposite ends thereof, a device suitable for screwing the body onto drill pipes, in which two valves are housed, of which one valve (A) is radial to said short body, interceptable from the outside by means an adaptor and equipped with a suitable safety plug, the other valve (B) being axial with respect to the body.

8 Claims, 1 Drawing Sheet

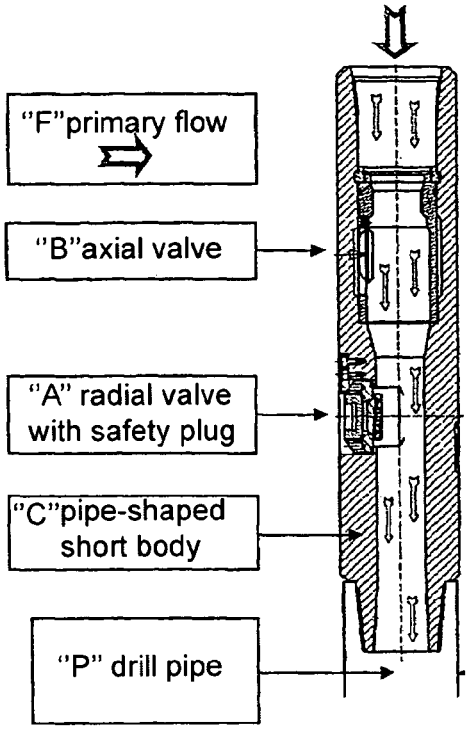
Fig. 1
Fig. 2
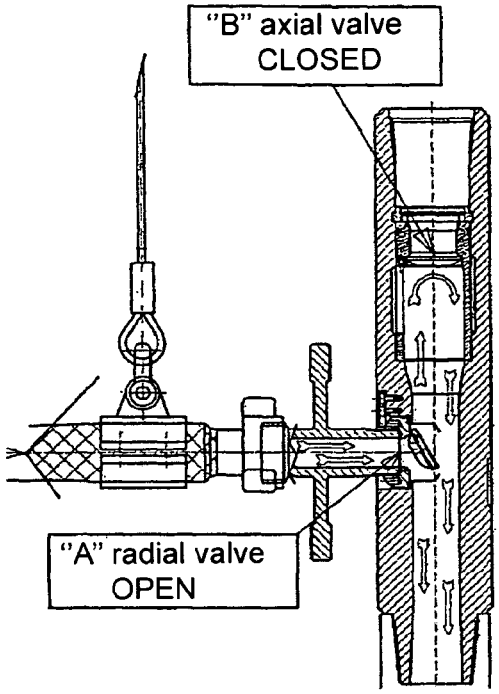
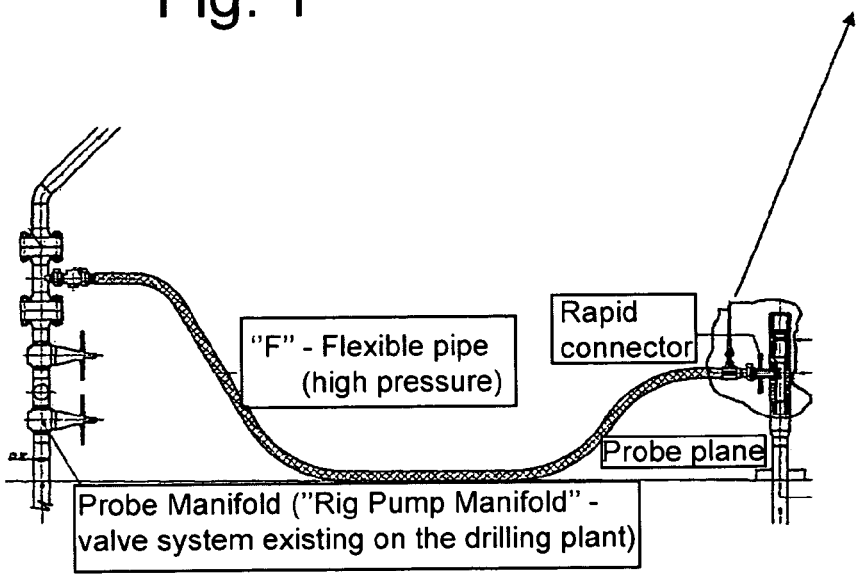
Fig. 3

DEVICE AND PROCEDURE FOR THE INSERTION OF A NEW DRILLING STRING-ELEMENT INTO THE DRILL-STRING OF A WELL

The present invention relates to a device and the relative procedure for the insertion of a new drilling string-element into a well.

From the very beginning of rotary drilling, over a century ago, which substituted the advance technique known as "percussion" used up until then, introducing the innovative principle of the use of drill pipes for transmitting a rotary movement to the bit (associated with the pumping of a fluid into the well through the same "string" of pipes), there has been the problem of interrupting the pumping process every time it was necessary to add a new pipe to the set, for drilling ahead.

This transition time, starting from the moment in which the pumping of the fluid into the well is interrupted until the pumping action into the well is re-established, after adding a new single element to the string of pipes, has always been considered a critical period. This critical period remains until the condition existing before the interruption of the pumping of fluid into the well, has been re-established.

Some of the undesired effects caused by the conventional interruption of the circulation of fluid in the well during the insertion and connection, or disconnection, of an element in the drilling string, are listed below:

- there is a lack of dynamic pressure induced in the well by the circulation together with its effect conventionally defined as ECD (Equivalent Circulating Density);
- the dynamic pressure induced at the well bottom is nullified, favouring the potential inlet of formation fluids into the well (kick);
- when the circulation is restarted, after the addition of the pipe effected with a conventional method, trouble-some overloads (overburden) of more receptive formations, or potential losses of circulation in the weaker formations, can be created;
- in wells with a high degree of verticality, the free and rapid fallout of drill cuttings can cause "mechanical stucking" conditions of the drilling string (BHA);
- in the presence of wells with significant tilting angle, in wells with an extended reach and in horizontally developed wells, the drill cuttings have sufficient time to settle on the lower part of the hole;
- when the drilling is restarted, after the insertion of a new pipe, the bit is "compelled" to redrill the bed of cuttings which have settled at the well bottom, before being able to reach the new virgin formation.

A device has now been found, which we have called ECD, which allows the pumping, and consequently the fluid circulation into the well, to be kept uninterruptedly active during all the operational steps necessary for effecting the addition of a new "single element" into the string of pipes, which enables drilling to be performed to a greater depth.

With the same procedure, it is possible to repeat the process in a reverse sequence, allowing the bit to be extracted without interrupting the fluid pumping in the well.

The main result obtained from this operative opportunity offered by the device is the elimination (or abatement) of all the critical aspects implicit in the traditional process for the addition or removal of pipes from the drill-string in the well.

The device, which is the object of the present invention, for the insertion of a new drilling string essentially consists in a short pipe-shaped body (C) having, at the ends, thereof, means suitable for screwing the same onto drill pipes, in which two valves are housed, of which one (A) is radial to said short body, interceptable from the outside by means of an adaptor and equipped with a suitable safety plug, preferably with a pressure seal, the other (B) axial to said body.

This consequently creates a valve system which allows direct contact to be made with the fluid pumped into the well through the drilling string, whenever desired and in both directions of the descending flow (radially and axially).

The short body of the device preferably has a length ranging from 50 to 100 cm.

The valve (A), which is radial to the drilling string, can be intercepted from outside by means of a suitable adaptor (for example a rapid connector), in turn coupled with a flexible pipe which has the function of interconnecting the device with the well pumping system ("Rig pump manifold"), of the drilling plant (drilling rig unit) it-self.

The valve (B) which is axial to the drilling string and has characteristics of "bi-directional reactive sensitivity" to the pressure to which it is subjected (therefore sensitive to the flow state of the drilling fluid pumped into the well), in turn consequently closes and opens directionally to the flow.

Both the radial valve (A) and the axial valve (B) are preferably throttle valves, possibly preloaded with springs, which are closed in a rest position.

To summarize, the configuration of the two valves housed in a short body, as described so far, allows an uninterrupted flow of drilling fluid towards the well, to be maintained, during all the operative steps necessary for effecting the addition to the string of a new "single pipe element" (or various pipes) which enables drilling to be performed in greater depth.

Apart from the conceptual and constructive simplicity, one of the intrinsic advantages of the device according to the invention is that it can be immediately used by any drilling plant (drilling rig unit), without implying heavy modifications to the hydraulic circuit of the plant itself, or associated problems of "vertical spatiality" for the insertion of the tool into the drilling string.

The device can be used in any type of any existing rig in the world—with no exclusion—whether it be extremely obsolete or very modern, whether it be equipped with the traditional pipe rotation system (called "Rotary Table System") or the more modern "Top Drive System", either in well drilling on land or offshore.

Higher operating pressures can obviously be obtained by selecting more highly performing single components, for assembling the desired tool.

There are numerous benefits derived from not interrupting the circulation, but such can vary each time depending on the type of well to which the praxis is applied.

In any case, the common benefit for each type of well is the resulting constant pressure state on the walls of the well and at the bottom of the well which ensure a valuable intrinsic security.

Let us consider in particular application in High Pressure and High Temperature Wells (HPHT).

In this type of well, the fracture gradients of the penetrated formations, close to the mineralized rock (reservoir), generally approaches the value of the pore gradient. For this reason, a careful control of the ECD (equivalent circulating density) is necessary and imperative for avoiding circulation losses and the structural weakening of the formation itself.

During interruptions in the circulation (necessary for effecting a conventional connection), the ECD is annulled, creating the ideal condition for the undesired entrance of state fluid, into the well (influx).

The influx can either come directly from the reservoir (primary porosity) or from induced micro-fractures; in any case, observation of the phenomenon (and the identification of the necessary condition for a new connection) requires a loss of operative time which is consequently non-productive.

The "uninterrupted circulation" by means of the device according to the invention, on the contrary, guarantees undisturbed dynamic conditions, allowing the safe, immediate insertion of a new pipe, without wasting any time.

Let us consider in particular the application for drilling known as under Balance/Close to Balance/Balance Drilling (UBD and similar options).

For drilling of the Underbalance (UBD)type wells and its derivatives, the maintenance of a stable and controlled regime pressure condition, distributed on the walls of the hole and also on the well bottom, is crucial. The loss of this condition can jeopardize all that has been effected upstream for UBD drilling. The addition of a pipe to the drilling string is a particularly critical moment; the use of the device according to the invention immediately eliminates all critical aspects, as it always guarantees undisturbed dynamic conditions, allowing the safe and immediate insertion of a new pipe without time losses. The guarantee of maintaining a constant and stable pressure regime on the walls of the hole and bottom of the well, prevents the accumulation of gas "bags" and "packs" of cuttings, which would require non-productive time for being eliminated and re-establishing the stable conditions as prior to the interruption of the circulation. An error in the handling of this process can jeopardize the entire UBD well project, activating an undesired accidental "well killing".

An alternative option to the use of the device according to the invention, can be to integrated, directly in the construction phase of the drill pipe, the valve system forming the device itself; this option would allow the length of the unit (pipe+ device) to be kept exactly identical to that of a "naked" pipe, when the necessity arises for its use.

In any case, lengths consisting of drill pipes equipped with the device, will house the system at the head of any length.

A further object of the present patent application is, therefore, an alternative to the device itself: a drill pipe essentially consisting of a pipe carrying at the ends suitable threads for being screwed onto other drill pipes, in which two valves are housed, one of which (A) radial to said pipe, which can be intercepted from the outside by means of an adapter and equipped with a suitable safety plug, preferably a pressure seal, the other (B) axial to said pipe.

Both the radial (A) and the axial (B) valve housed in the pipe are preferably throttle valves, more preferably preloaded with springs, which are closed when at rest.

A further object of the present application relates to the process for inserting a new drilling string.

The process for inserting a new drilling string is characterized in that it uses the devices described above, according to the invention, or, as an alternative, the drill pipes described above, equipped with radial and axial valves.

More particularly, said process can include the following steps:

Intercepting from the outside and connecting by suitable means to the drilling pumping system, the radial valve (A) of the short body or of the drill pipe by means of a suitable connector;

voluntarily interrupting the primary fluid flow, through the injection head, at the inlet of the drilling string, with the consequent passage of the fluid from the radial (A) valve only, and the consequent closing of the axial valve (B);

inserting on the short body or on the drill pipe a new drilling string coupled with a new short body, wherein said valves are housed or a new drilling string containing a drill pipe in which said valves are housed;

re-establishing the primary fluid flow with the consequent opening of the axial valve (B) and consequent closing of the radial valve (A);

disconnecting the connector and protecting the radial valve (A) by means of a safety plug;

lowering the drilling string in hole.

Finally, the final result of the operations described above would allow the insertion and connection process of a perforating string element (single pipe or length), to be effected at a full flow-rate and without continuity interruption.

An embodiment of the present invention is now described with the help of FIGS. 1, 2 and 3.

FIG. 1 shows the device according to the invention during the drilling phase wherein the primary flow (F) alone passes through the device axially.

FIG. 2 shows the device according to the invention during the drilling phase wherein the primary flow (F) is interrupted, whereas the secondary flow enters the device radially.

FIG. 3 shows the connection system of the device to the pumping system in the well.

The device in FIG. 1 shows a short body (C) which essentially consists of a pipe in which two valves are housed, one of which (A) radially to said body and closed, the other (B), axially to the short body and open.

This device is screwed onto a traditional drill pipe (P). In FIG. 2 and FIG. 3, the same device has the axial valve closed, whereas the radial valve is open, intercepted from the outside by means of an adaptor, which can be a fast connector, in turn coupled to a flexible pipe (F) which has the function of interconnecting the device with the well pumping system ("rig pump manifold") of the drilling plant.

In order to effect the connection, i.e. the addition of a single pipe (or a whole length of pipes) in the drilling string, without interrupting the pumping of the drill fluid into the well, it is necessary to interrupt this primary flow with some expedient, at the beginning of the process, and simultaneously substitute this primary flow with an equivalent flow, which enters the drill pipe string below the segregation point of the flow generated by the device.

This necessity is controlled by the two valves situated in the device itself, suitably positioned radially and axially and to the drilling string.

Once the valve (A) radial to the drilling string has been intercepted from the outside and connected to the flexible pipe and therefore to the whole well pumping system of the drilling plant (rig pump manifold), the drilling fluid at the well inlet can intercept two independent and distinct flow lines, an axial one and a radial one with respect to the drilling string.

When the primary fluid flow at the inlet of the string is subsequently voluntarily interrupted, by closing the corresponding valve on the rig pump manifold, the valve "B" of the device will consequently close and the whole flow coming from the plant pumping system will be forced to pass through the radial valve "A" of the device, with no other external intervention.

At this point of the process, the pressure segregated upstream of the axial valve "B" of the device can be released to atmospheric pressure (for example, through the discharge valve of the rig pump manifold) obtaining the necessary condition for effecting the connection of a single pipe (or an entire pipe length) in the drilling string, under safe conditions.

Once the connection has been effected, the flow towards the primary path will be restored again, i.e. through the valve "B" of the device, by repeating the above sequence in an inverse direction.

The invention claimed is:

1. A device for the insertion of a new drilling string element into a drilling string of a well, comprising:

an adaptor;

a pipe-shaped body having a longitudinal bore and threading at longitudinal end portions thereof for screwing the pipe-shaped body onto drilling string elements of the drilling string;

a first normally closed valve housed at said pipe-shaped body, said first valve providing a passage extending radially through a wall of said pipe-shaped body to said longitudinal bore and a safety plug capable of selectively closing said passage, whereby the longitudinal bore is accessible from outside of said body by adaptor; and a second valve housed at said pipe-shaped body and configured to selectively close the longitudinal bore at one of said end portions of said pipe shaped body.

2. The device according to claim 1, wherein said pipe-shaped body has a length ranging from 50 to 100 cm.

3. The device of claim 1, whereby the second valve is normally open and is adapted to be closed by fluid pressure when the fluid is passed to said first valve.

4. A process for the insertion of a new drilling string element into a drilling string of a well receiving a flow of a pumped fluid by a well pumping system, the drilling string including drilling string elements and a device comprising a pipe-shaped body having a longitudinal bore and threading at longitudinal end portions thereof for screwing the pipe-shaped body onto the drilling string elements; a first valve housed at said pipe-shaped body, said first valve providing a passage extending radially through a wall of said pipe-shaped body to said longitudinal bore and a safety plug capable of selectively closing said passage, whereby the longitudinal bore is accessible from outside of said body by an adaptor; and a second valve housed at said pipe-shaped body and configured to selectively close the longitudinal bore at one of said end portions of said pipe shaped body, the process comprising the steps of:

intercepting said first valve of the device from an outside location and connecting said first valve of the device to the well pumping system by a connecting device;

interrupting primary fluid flow through an injection head at an inlet of said drilling string and passing the fluid exclusively to said first valve of the device and closing said second valve of the device;

inserting on said device the new drilling string element which is coupled with another device which is equal to said device;

reestablishing the primary fluid flow with consequent opening of said second valve of the device and closing of said first valve of the device;

disconnecting the connecting device and protecting said second valve of the device with the safety plug; and lowering the drilling string into the well.

5. The process of claim 4, wherein the pipe-shaped body has a length ranging from 50 to 100 cm.

6. A drill pipe, comprising:

an adaptor;

a pipe-shaped body having a longitudinal bore and threading at longitudinal end portions thereof for screwing the pipe-shaped body onto another drill pipe;

a first normally closed valve housed at said pipe-shaped body, said first valve providing a passage extending radially through a wall of said pipe-shaped body to said longitudinal bore and a safety plug capable of selectively closing said passage, whereby the longitudinal bore is accessible from outside of said body by an adaptor; and a second valve housed at said pipe-shaped body and configured to selectively close the longitudinal bore at one of said end portions of said pipe shaped body.

7. The drill pipe of claim 6, whereby the second valve is normally open and is adapted to be closed by fluid pressure when the fluid is passed to said first valve.

8. A process for the insertion of a new drilling string element into a drilling string of a well receiving a flow of a pumped fluid by a well pumping system, the drilling string including drill pipes, as drilling string elements, comprising a pipe-shaped body having a longitudinal bore and threading at longitudinal end portions thereof for screwing the pipe-shaped body onto the drilling string elements; a first valve housed at said pipe-shaped body, said first valve providing a passage extending radially through a wall of said pipe-shaped body to said longitudinal bore and a safety plug capable of selectively closing said passage, whereby the longitudinal bore is accessible from outside of said body by an adaptor; and a second valve housed at said pipe-shaped body and configured to selectively close the longitudinal bore at one of said end portions of said pipe shaped body, the process comprising the steps of:

intercepting said first valve of the drill pipe from an outside location and connecting said first valve of the drill pipe to the well pumping system by a connecting device;

interrupting primary fluid flow through an injection head at an inlet of said drilling string and passing the fluid exclusively to said first valve of the drill pipe and closing said second valve of the drill pipe;

inserting on said drill pipe another drill pipe which is equal to said drill pipe;

reestablishing the primary fluid flow with consequent opening of said second valve of the drill pipe and closing of said first valve of the drill pipe;

disconnecting the connecting device and protecting said second valve of the drill pipe with the safety plug; and lowering the drilling string into the well.

* * * * *

UNITED STATES PATENT AND TRADEMARK OFFICE

CERTIFICATE OF CORRECTION

PATENT NO. : 7,845,433 B2
APPLICATION NO. : 11/449662
DATED : December 7, 2010
INVENTOR(S) : Angelo Calderoni et al.

It is certified that error appears in the above-identified patent and that said Letters Patent is hereby corrected as shown below:

On the title page, Item (30), the Foreign Application Priority Data has been omitted. Item (30) should read:

-- (30) Foreign Application Priority Data

June 14, 2005 (IT) ..... MI2005A 001108 --

Signed and Sealed this
Twenty-second Day of February, 2011

David J. Kappos

David J. Kappos
*Director of the United States Patent and Trademark Office*